US005362168A

United States Patent [19]

Abe et al.

[11] Patent Number: 5,362,168

[45] Date of Patent: Nov. 8, 1994

[54] WRITING DEVICE WITH SPACED WALLS AND SLIDING VALVE

[75] Inventors: Shinichi Abe; Mitsuo Ohtani, both of Tokyo, Japan

[73] Assignee: Zebra Co., Ltd., Tokyo, Japan

[21] Appl. No.: 55,668

[22] Filed: Apr. 29, 1993

[30] Foreign Application Priority Data

Oct. 21, 1992 [JP] Japan ..... 4-283096
Mar. 30, 1993 [JP] Japan ..... 5-072202

[51] Int. Cl.[5] ..... B43K 8/02; B43K 8/04

[52] U.S. Cl. ..... 401/206; 401/198; 401/199

[58] Field of Search ..... 401/206, 198, 199

[56] References Cited

U.S. PATENT DOCUMENTS

| | | | |
|---|---|---|---|
| 550,763 | 12/1895 | Osmun | 401/198 |
| 1,523,332 | 1/1925 | Wright | 401/206 |
| 2,643,409 | 6/1953 | Hemple et al. | 401/206 |
| 3,221,360 | 12/1965 | Seeman | 401/198 X |
| 3,377,124 | 4/1968 | Matsumoto | 401/206 X |
| 3,640,631 | 2/1972 | Sotir | 401/206 |
| 4,209,263 | 6/1980 | Droubay | 401/198 |

FOREIGN PATENT DOCUMENTS

| | | | |
|---|---|---|---|
| 2567813 | 1/1986 | France | 401/206 |
| 57-118879 | of 0000 | Japan . | |
| 2189689 | 11/1987 | United Kingdom | 401/206 |

*Primary Examiner*—Steven A. Bratlie
*Attorney, Agent, or Firm*—Klauber & Jackson

[57] ABSTRACT

A writing device including a main body portion having at the front end a writing tip through an ink flow-out control mechanism comprising a valve main body including ink introducing ports, a valve element supported in the valve main body movably forward and backward, and a coil spring for biasing a valve element in the direction of closing a valve seat inserted in the valve main body. The main body portion is formed of an inner pipe and an outer pipe, and a heat shielding space is provided between both pipes. Further, the spring pressure of the coil spring for biasing the valve element in the direction of closing the valve seat inserted in the valve main body is specified to be approximately identical to the writing pressure in writing, and a restriction portion for restricting the opening amount of the valve element against the valve seat is provided at either of the valve element or the valve main body.

11 Claims, 6 Drawing Sheets

WRITING DEVICE WITH SPACED WALLS AND SLIDING VALVE

FIELD OF THE INVENTION

The present invention relates to a writing device, and particularly to the improvement of a writing device including a main body portion to be held in writing, which has at the front end a writing tip through an ink flow-out control mechanism comprising a valve main body including ink introducing ports, a valve element supported movably forward and backward in the valve main body, and a coil spring for biasing a valve element in the direction of closing a valve seat inserted in the valve main body.

DESCRIPTION OF THE RELATED ART

Conventionally, a writing device of a type in which a main body to be held in writing is directly filled with an ink is so constructed as follows. In the writing device of this type, the body heat of a writer in writing is transmitted from the cylindrical wall of the main body portion to the inside containing the ink, so that the temperature in the main body portion is increased. Thus, the internal pressure in the main body portion is increased, which causes the wasteful flow-out of the ink to the outside. To prevent the above wasteful flow-out of the ink, an ink flow-out control mechanism of a valve or bellows structure is provided. In FIG. 6, the ink flow-out control mechanism using a valve element 32 biased by a coil spring 31 in the direction of closing a valve seat 30 is built in the front end of a main body portion 33, and a writing tip 34 for transferring an ink 1 on the surface of a writing paper through this ink flow-out control mechanism is mounted at the front end of the main body portion 33.

Incidentally, in the ink flow-out control mechanism, particularly, in the type having a bellows structure differently from that shown in the figure, when the pressure change in the main body portion 33 is small, the function (control effect) can be achieved. However, when the internal pressure exceeds a critical value, the function cannot be achieved at all, and accordingly, the ink 1 in the main body portion 33 is allowed to excessively flow out on the writing tip 34 side in writing, thereby causing the drop of the ink 1. This brings about a problem of making dirty the surface of the writing paper, and therefore the countermeasure to the above problem has been desired.

In general, the ink flow-out control mechanism of the writing device of this kind has such a construction as shown in FIG. 6. Namely, it comprises a valve main body 36 which includes around the peripheral surface of the rear end side thereof ink introducing ports 35 contacted with an internal ink 1 in the main body portion 33 containing the ink 1; a bar-like valve element 32 contained in the valve main body 36 movably forward and backward, with the rear end side thereof slidably inserted in a rear end valve supporting portion 36*a* of the valve main body 36; and a coil spring 31 for biasing the valve element 32 by a spring force stronger than the writing pressure in writing toward the valve seat 30 inserted in the front end of the valve main body 36. When the writing device is not used, a valve body 32*a* of the valve element 32 is seated on a valve seat 30*a* of the valve seat body 30 by the spring force (biasing force) of the coil spring 31 to stop the flow-out, that is, the supply of the ink 1 in the main body portion 33 to the writing tip 34. On the other hand, in writing, the writing tip 34 is pressed on the surface of the writing paper and a force is thereby applied against the spring force of the coil spring 31, to move backward the valve element 32 together with the writing tip 34, so that the valve body 32*a* of the valve element 32 is separated from the valve seat 30*a*, to thus supply the ink 1 in the main body portion 33 to the writing tip 34.

However, since the ink flow-out control mechanism of the prior art writing device is so constructed that the valve element 32 is biased by the coil spring 31 stronger than the writing pressure in writing in the direction of closing the valve seat body 30, the supply of the ink 1 in the main body portion 33 to the writing tip 34 is interrupted, which obstructs the continuous smooth writing. Accordingly, when the writing is interrupted as described above, in the conventional manner, the supply of the ink 1 to the writing tip 34 must be carried out by pressing the writing tip 34 on the surface of the writing paper with a relatively larger force against the spring force of the coil spring 31. This causes an inconvenience in handling.

Also, the valve element 32 in the ink flow-out control mechanism of the prior art writing device is formed in a shaft shape having the valve body 32*a*, which is seated on the valve seat 30*a* of the valve seat body 30 closing the valve seat body 30, outwardly in the midway of the length direction in a flange-shape. Namely, the valve element 32 has a length extending from the front end abutted on and connected to the rear end of the writing tip 34 side to the valve body 32*a*. In other words, while the ink 1 is allowed to flow out from the inside of the main body portion 33 on the writing tip 34 side by separation of the valve body 32*a* from the valve seat 30*a*, the distance from the valve seat 30*a* to the writing tip 34 abutted on and connected to the rear end of the valve element 32 is relatively long, which takes a lot of time until the ink 1 flowed out from the inside of the main body portion 33 on the writing tip 34 side reaches the writing tip 34. Accordingly, particularly in the initial writing with the purchased writing device, or in the writing with the writing device not used for a long period, it is difficult to supply the ink 1 in the main body portion 33 to the writing tip 34, so that it takes a lot of time until the ink 1 permeates in the writing tip 34 by the capillary action and the writing possible state is achieved, thus causing an inconvenience in handling.

OBJECT AND SUMMARY OF THE INVENTION

Accordingly, an object of the present invention is to prevent the temperature change, particularly, the temperature rise in a main body portion filled with an ink in writing, and hence to keep constant the internal pressure in the main body portion.

Another object of the present invention is to allow the ink in the main body portion to flow out and be supplied to the writing tip by the writing pressure in writing, and to eliminate the interruption of the supply in the writing.

A further object of the present invention is to usually supply the ink in a specified amount from the main body portion to the writing tip in writing.

The other objects will be apparent from the detailed description of the preferred embodiments and the accompanying drawings.

The above objects can be accomplished by a writing device of the present invention.

In a first aspect of the present invention, there is provided a writing device comprising a main body portion, which is held in writing, directly filled with an ink, wherein the main body portion is formed in a double cylindrical structure constituted of an inner pipe filled with the ink and an outer pipe provided outwardly of the inner pipe substantially over the whole length; a heat shielding space is formed between the outer pipe and the inner pipe; and external communication holes communicated to the heat shielding space are provided at suitable positions of the outer pipe.

According to the writing device of the first invention, when the writer keeps such a writing attitude as holding the main body portion, the body heat of the writer is prevented from being transmitted to the inner pipe by the heat shielding space formed between the outer pipe and the inner pipe, thus making it possible to keep constant the internal pressure in the inner pipe containing the ink.

In a second aspect of the present invention, there is provided a writing device comprising a main body portion containing an ink, which mounts at the front end a writing tip through an ink flow-out control mechanism including: a valve main body including ink introducing ports; a valve element supported in the valve main body movably forward and backward; and a coil spring for biasing the valve element in the direction of closing a valve seat inserted in the valve main body, wherein the spring pressure of the coil spring is specified to be approximately identical to the writing pressure in writing; a restriction portion for restricting the opening amount of the valve element to the valve seat is provided at either of the valve element or the valve main body; and the length of the valve element at the front end side is specified such that the front end of the valve element is abutted on the valve seat so as to close the valve seat, while the length of the writing device is specified such that the front end of the writing device is abutted on or inserted in the front end of the valve element.

According to the writing device of the second invention, by softly pressing the writing tip on the surface of the writing paper as in writing characters, the valve element is moved backward to be separated from the valve seat against the coil spring, so that the valve seat is opened for allowing the ink in the main body portion to flow out and be supplied on the writing tip side. At this time, the writing tip is positioned in such a manner as to be abutted on or fitted to the front end portion of the valve element seated on the valve seat, and the ink in the main body portion is supplied to the writing tip as soon as the valve element is separated from the valve seat. Since the amount of the backward movement of the valve element is restricted by the restriction portion, the separation distance of the valve element from the valve seat is kept constant. In other words, the opening state of the valve element to the valve seat is kept constant, and the ink in a specified amount (suitable amount) is usually allowed to flow out and be supplied from the main body portion to the writing tip.

DETAILED DESCRIPTION OF THE PREFERRED EMBODIMENTS

Figure 1:
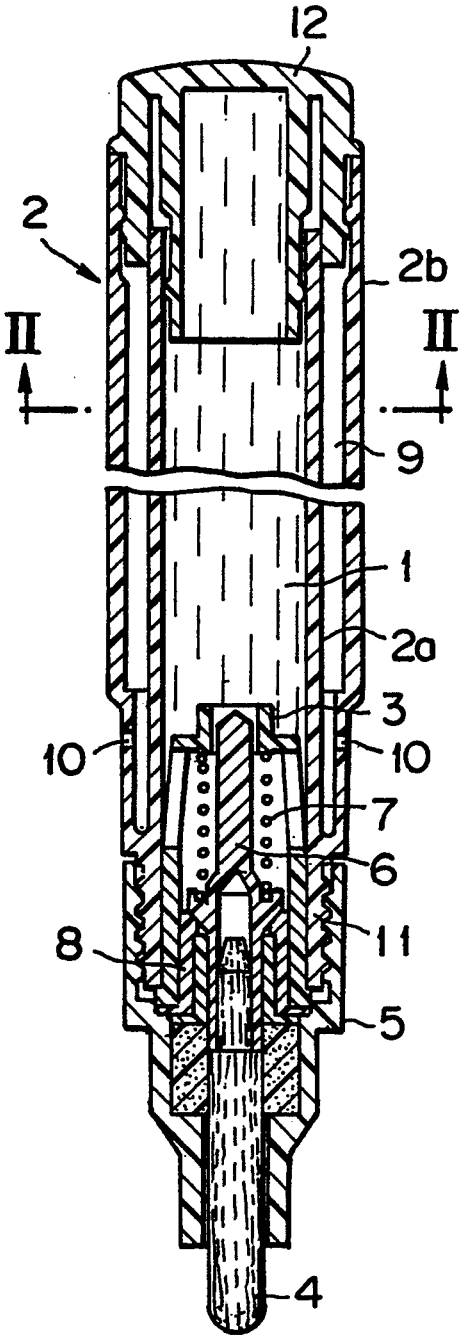
FIG. 1 is a vertical front view showing one embodiment of a writing device of the present invention.
Figure 2:
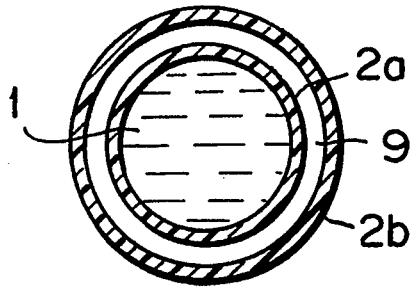
FIG. 2 is a transverse sectional view taken along the line II—II of FIG. 1.
Figure 3:
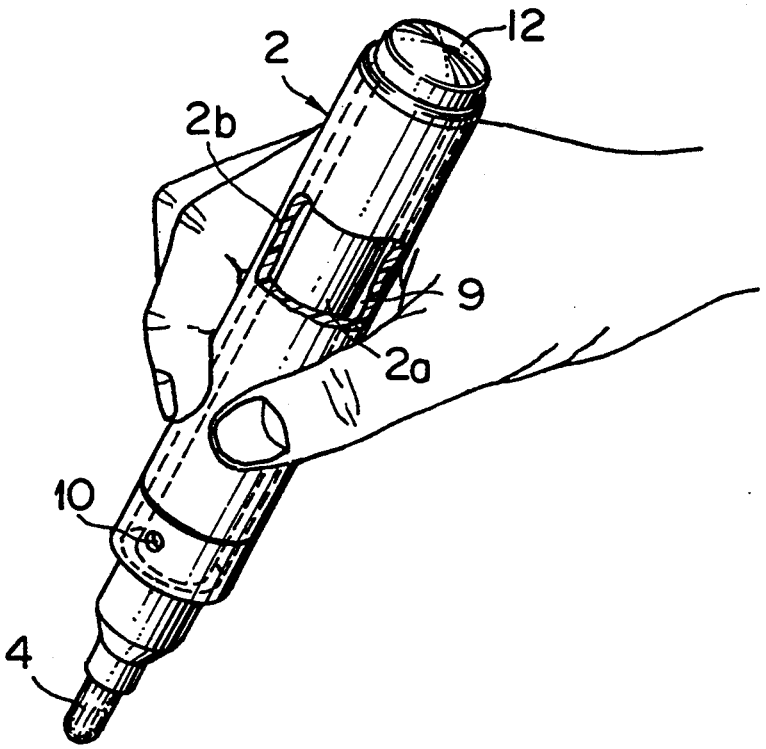
FIG. 3 is a perspective view showing the using state.

Hereinafter, embodiments of the present invention will be described with reference to the drawings. FIGS. 1 to 3 show a writing device of a first invention. In this writing device, at the front end of a main body portion 2 filled with an ink 1, a writing tip 4 for introducing the ink 1 to the front end through an ink flow-out control mechanism using the capillary action is supported and mounted on a front end case 5 provided at the front end of the main body portion 3. By pressing the writing tip 4 on the surface of a writing paper in such a manner as to be depressed in the front end case 5, a valve element 6, which is mounted movably forward and backward in a valve main body 3 of the ink flow-out control mechanism, is separated from a valve seat 8 against a coil spring 7, thereby opening the valve seat 8. Thus, the ink 1 in the main body portion 2 flows out on the writing tip 4 side, and permeates in the writing tip 4 by the capillary action, to be transferred on the surface of the writing paper.

The main body portion 2 is constituted of an inner pipe 2*a* filled with the ink 1, and an outer pipe 2*b* provided outwardly of the inner pipe 2*a* substantially over the whole length. A heat shielding space 9 is formed between the outer pipe 2*b* and the inner pipe 2*a*, and external communication holes 10 are provided at suitable positions of the outer pipe 2*b*.

The inner pipe 2*a* and the outer pipe 2*b* are formed by injection molding in such a manner that the front end sides are integrally connected to each other and the rear end sides are open, and further, the heat shielding space 9 is provided therebetween with a suitable interval. Specifically, the front end of the outer pipe 2*b* is integrally connected to the base portion of a connection portion 11 screwed with the front end case 5 at the front end of the inner pipe 2*a*. Also, the outer pipe 2*b* is provided outwardly from the connected portion substantially over the whole length with a suitable interval for certainly forming the heat shielding space 9 between the inner pipe 2*a* and the outer pipe 2*b*. Thus, by fitting a tail plug 12, separately formed, to the open portions at the rear ends of both the pipes 2*a* and 2*b*, the heat shielding space 9 is formed between both of the pipes 2*a* and 2*b*.

The external communication holes 10, which communicate through the outer pipe 2*b* to the heat shielding space 9, are formed at suitable positions of the outer pipe 2*b* in the vicinity of where the outer pipe 2*b* and the inner pipe 2*a* are connected. By the flow-in of the outside air through the external communication holes 10 into the heat shielding space 9, the temperature in the space 9 is prevented from being increased by the body heat of a writer and is thus kept in the ordinary temperature state.

As described above, according to the writing device of the first invention, as shown in FIG. 3, the main body portion 2 held by a writer has a double cylindrical structure constituted of the inner pipe 2*a* and the outer pipe 2b, and the heat shielding space 9 for preventing the body heat of the writer from being transmitted to the inner pipe 2a containing the ink 1 is formed between both the pipes 2a and 2b. Accordingly, even if the writer keeps such a writing attitude as holding the main body portion 2 for a long period of time, the body heat of the writer is prevented from being transmitted to the inner pipe 2a by the effect of the heat shielding space 9. Therefore, since the body heat of the writer is not transmitted to the inner pipe 2a filled with the ink 1, the internal pressure in the inner pipe 2a is not increased and is thus kept constant. On the other hand, the temperature in the heat shielding space 9 is prevented from being increased and thus kept constant by the flow-in of the outside air through the external communication holes 10 provided around the outer pipe 2b.

Accordingly, the temperature change in the main body portion 2 filled with the ink 1, particularly the temperature rise due to the body heat of the writer, can be certainly prevented, so that the internal pressure in the main body portion 2 can be kept constant. This makes it possible to prevent the excessive (wasteful) flow-out of the ink 1 accompanied with an increase in the internal pressure in writing.

Figure 4:
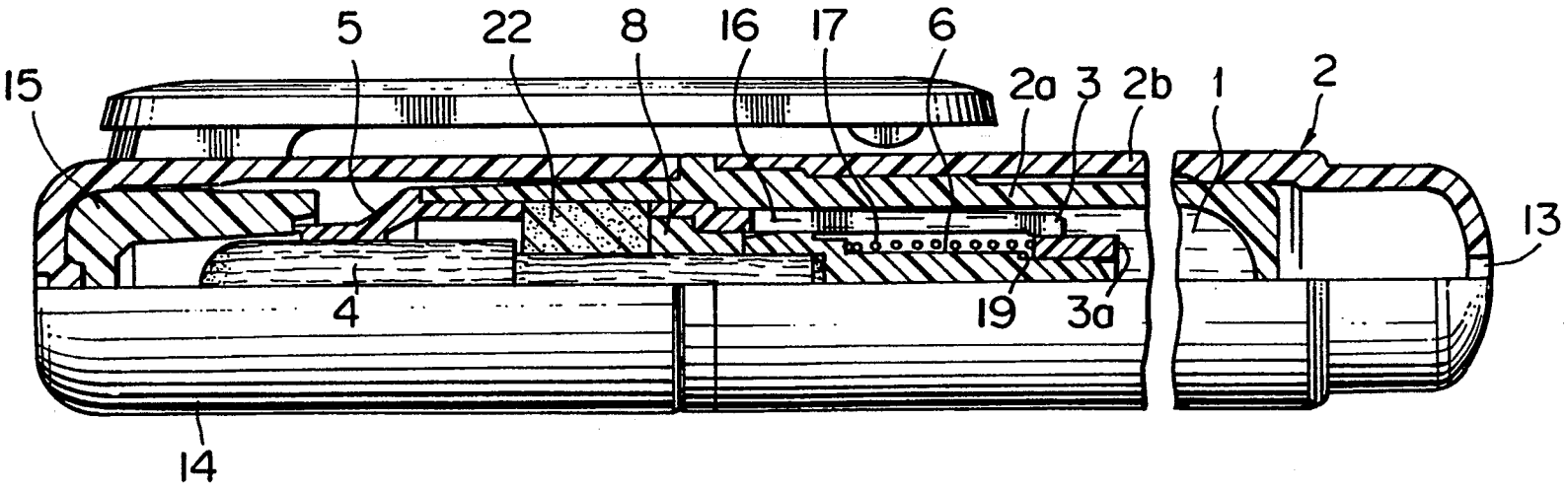
FIG. 4 is a vertical side view showing one embodiment of a second invention, with parts partially omitted.
Figure 5A:
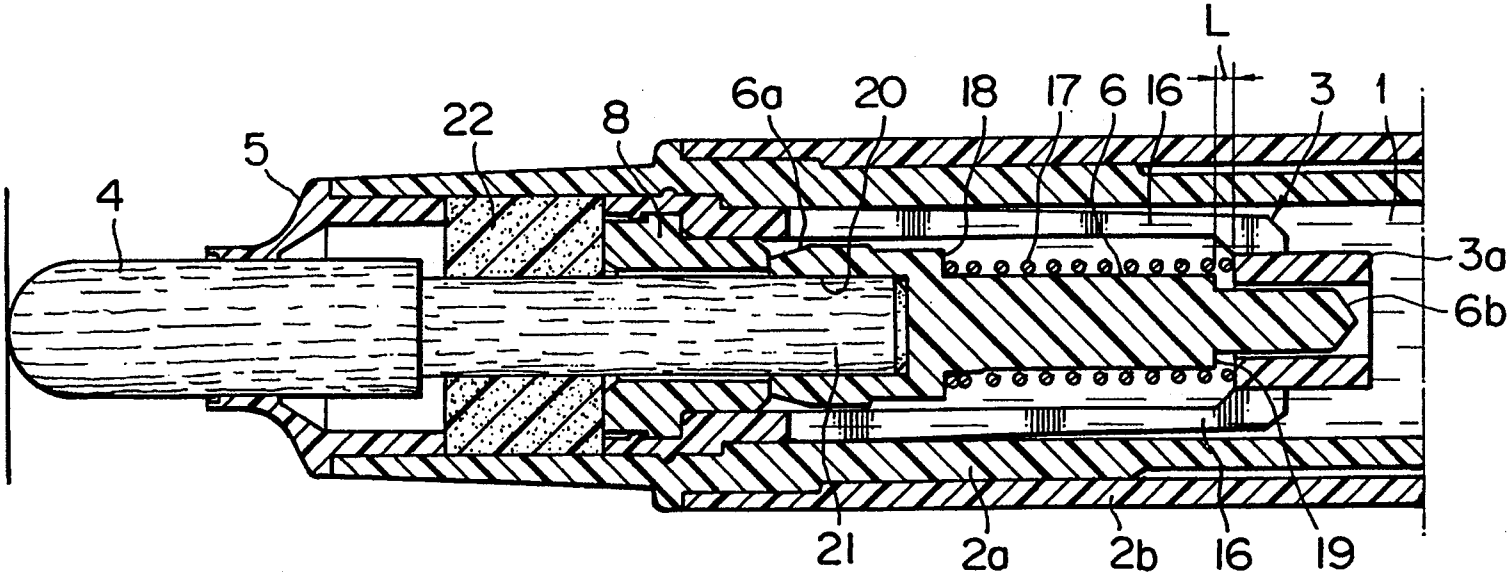
FIGS. 5(*a*) and 5(*b*) are enlarged sectional views showing the main parts of the writing device of FIG. 4, wherein FIG. 5(*a*) shows the state that the writing pressure is not applied to the writing tip, and FIG. 5(*b*) shows the state that the writing pressure is applied to the writing tip.
Figure 5B:
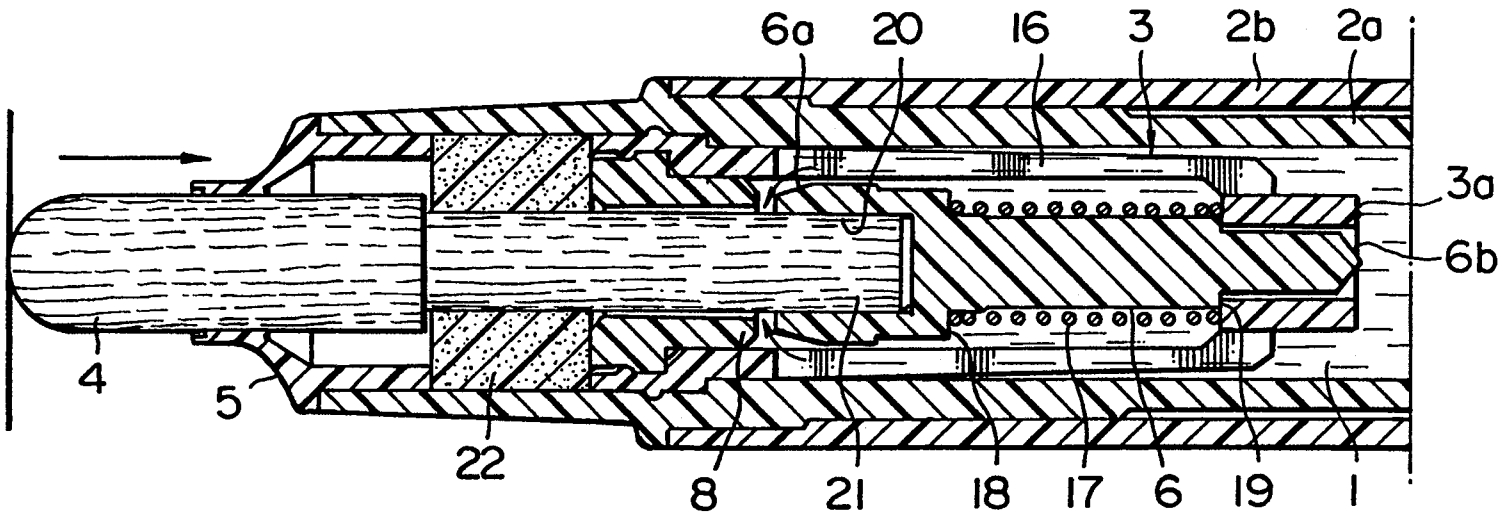
Figure 6:
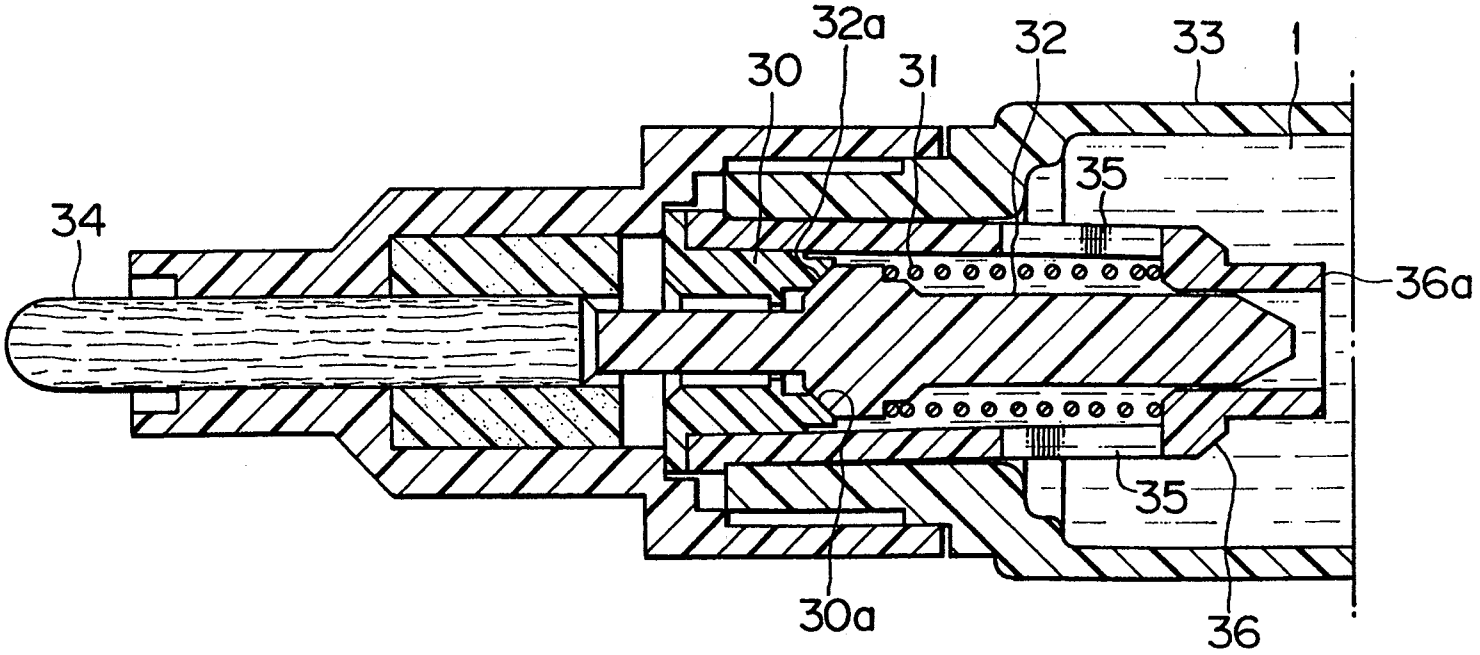
FIG. 6 PRIOR ART
FIG. 6 is a vertical sectional view of a prior art writing device.

FIGS. 4 and 5 show a writing device according to the second invention. In this writing device, a main body 2 similar to that described in detail in the first invention has a double cylindrical structure constituted of: an inner pipe 2a having a diameter to be easily held in writing and a suitable length, wherein the front end is opened and the rear end has a bottom; and an outer pipe 2b removably inserted outwardly of the inner pipe 2a substantially over the whole length, wherein the front end is opened and the rear end has a bottom. After the above inner pipe 2a is filled with an ink 1, an ink flow-out control mechanism is inserted in the front end side of the pipe 2a, and a writing tip 4 is mounted to the front end thereof.

In addition, an external communication hole 13 is perforated at the rear end of the outer pipe 2b, so that the outside air is allowed to flow in the outer pipe 2b. In FIG. 4, reference numeral 14 indicates a front end cap internally including a rubber seal 15 on the inner bottom portion.

The ink flow-out control mechanism comprises a valve main body 3 including ink introducing ports 16 around the periphery thereof; a bar-like valve element 6 coaxially supported in the valve main body 3 so as to be movable forward and backward; and a coil spring 17 for biasing the valve element 6 toward a valve seat 8 inserted in the valve main body 3. It functions to prevent the ink 1 in the inner pipe 2a of the main body portion 2 from flowing out on the writing tip 4 side when the writing device is not used. It is contained in the pipe 2a by insertion of the valve main body 3 in the inner pipe 2a of the main body portion 2.

The valve main body 3 is formed in a stepped cylindrical shape having an outside diameter being approximately identical to the inside diameter of the inner pipe 2a of the main body portion 2 and a suitable length. In the opening portion at the front end of the valve main body 3, the valve seat 8 in a stepped cylindrical shape is inserted. Also, at the rear end of the valve main body 3, a valve supporting portion 3a in a cylindrical shape having a diameter smaller than the inside diameter of the valve main body 3 is integrally provided. Further, the valve main body 3 includes ink introducing ports 16 for introducing the ink 1 in the inner pipe 2a into the valve main body 3 at suitable positions of the main valve body 3 (in these figures, three positions) ranging from the valve supporting portion 3a to the vicinity of the front end, specifically, where a seating surface 6a of the valve element 6 seated on the valve seat 8 is positioned.

The valve element 6 has a specified length enough to be contained in the valve main body 3, and has a front end taken as a large diameter portion having a diameter approximately identical to the inside diameter of the valve main body 3. The rear end stepped portion of the above large diameter portion is formed in a stepped bar shape being taken as a locking portion 18 for locking one end of a coil spring 17. Thus, the front end of the large diameter portion is taken as a seating portion 6a, that is, a valve body, which is abutted and seated on the valve seat 8 by the coil spring 17 to close the valve seat 8. Also, at the rear end of the large diameter portion, an insertion portion 6b slidably inserted in the valve supporting portion 3a provided at the rear end of the valve main body 3 is coaxially projectingly provided. Further, at the base portion of the insertion portion 6b on the rear end side, a restriction portion 19 is provided, which is abutted on and locked on the valve supporting portion 3a at the rear end of the valve main body 3 for restricting the degree of the opening of the valve element 6 against the valve seat 8.

Also, a holding hole 20 for inserting and holding the writing tip 4 is provided at the front end axial core of the valve element 6. By insertion of a rear end fitting portion 21 (to be described later) of the writing tip 4 in the holding hole 20, the valve element 6 is integrated with the writing tip 4, thereby preventing the writing chip from being removed carelessly.

When the writing tip 4 is pressed in such a manner as to be depressed in the front end case 5 by the writing pressure in writing, the restriction portion 19 restricts the amount of the backward movement of the valve element 6 accompanied with the movement of the writing tip 4, and keeps the degree of the opening of the valve element 6 against the valve seat 8. In other words, irrespective of the degree of the writing pressure applied by the writer, it is possible to keep the valve opening state (degree of the valve opening) of the valve element 6 against the valve seat 8.

Accordingly, it is possible to usually supply the ink 1 in a specified amount (suitable amount) from the inner pipe 2 a to the writing tip 4. The restriction portion 19 is provided at the base portion of the insertion portion 6b at the rear end of the valve element 6 with the backward movement distance L (valve opening distance of the valve element 6 against the valve seat 8) put between the valve supporting portion 3a of the valve main body 3 and the same in the state that the seating portion 6a at the front end of the valve element 6 is seated on the valve seat 8. Namely, the length of the valve element 6 is specified such that, in the state that the front end seating portion 6a is seated on the valve seat 8, the rear end surface of the valve element 6 is positioned inside the valve supporting portion 3a of the valve main body 3 with an interval of the above backward movement distance L. The rear end surface thereof is projectingly provided with an insertion portion 6b.

The above writing tip 4 is intended to internally hold the impregnated ink 1, to lead the ink 1 to the front end by the capillary action, and to thus transfer it on the surface of a writing paper. It is formed of a known porous material or a fiber material in such a bar-like shape that the diameter thereof is approximately identical to that of the valve element 6 on the rear end side and the front end is formed in a spherical surface. Also, the length of the writing tip 4 is specified such that the spherical surface at the front end, when being in the state to be normally projected from the front end case 5, can be abutted on or inserted in the seating portion 6*a* of the front end of the valve element 6 seated on the valve seat 8. In these figures, the writing tip 4 is formed with a length enough to be inserted in the holding hole 20 at the front end of the valve element 6. The diameter of the writing tip 4 extending from the axial mid-portion to the rear end, which is slidably held by a ring-like holding body 22 mounted between the front end of the valve main body 3 and the rear end of the front end case 5 of the ink flow-out control mechanism contained in the inner pipe 2*a*, is specified to be approximately identical to the inside diameter of the ring-like holding body 22. Further, in the writing tip 4, the diameter of the rear end portion thereof is specified to be similar to or slightly larger than the bore of the holding hole 20, and the rear end portion is taken as a fitting portion 21. The fitting portion 21 is inserted in and connected to the holding hole 20 in the state of holding the elasticity.

The spring force (biasing force) of the coil spring 17 for biasing the valve element 6 toward the valve seat 8 for seating the valve element 6 on the valve seat 8 is specified to be approximately identical to the writing pressure in writing with which the valve element 6 is moved backward to be separated from the valve seat 8, preferably, to be slightly smaller than the writing pressure. Thus, by softly pressing the writing tip 4 on the surface of the writing paper as in writing characters, the valve element 6 is moved backward to be separated from the valve seat 8 against the coil spring 17, thereby opening the valve seat 8, which allows the ink 1 in the main body portion 2 to flow out and be supplied on the writing tip 4 side. When the writing device is not used, the valve element 6 is certainly seated on the valve seat 8 to close the valve seat 8.

As described above, according to the writing device of the second invention, in writing, by softly pressing the writing tip 4 on the surface of the writing paper as in writing characters, the valve element 6 is moved backward to be separated from the valve seat 8 against the coil spring 17 for opening the valve seat 8, which allows the ink 1 in the inner pipe 2*a* to flow out on the writing tip 4 side and to be supplied to the tip 4. At this time, the writing tip 4 is positioned in the state being inserted in and connected to the seating portion 6*a* at the front end of the valve element 6 seated on the valve seat 8. Namely, since the writing tip 4 is positioned in the state of passing through the valve seat 8 (as shown in FIG. 5(*a*)), the ink 1 around the valve main body 3 and the valve element 6 in the inner pipe 2*a* is rapidly supplied to the writing tip 4 as soon as the valve element 6 is separated from the valve seat 8. Accordingly, even if the impregnated amount of the ink 1 to the writing tip 4 is small as in the initial writing of the purchased writing device, the ink 1 is rapidly supplied to the writing tip 4, which achieves the writing possible state (as shown in FIG. 5(*b*)). Further, the supply of the ink 1 is not cut-off in writing, which enables the continuous writing without interruption.

The backward movement distance (movement amount) L of the valve element 6 in writing, that is, the opening state of the valve element 6 to the valve seat 8, is kept constant by the abutment and locking of the restriction portion 19 against the valve supporting portion 3*a* at the rear end of the valve main body 3. Accordingly, irrespective of the different writing pressure of the writer, the ink 1 in a specified amount (suitable amount) is usually allowed to flow out and be supplied from the inner pipe 2*a* to the writing tip 4, so that the drop of the ink 1 due to the excessive flow-out in writing is eliminated, thereby preventing the contamination of the surface of the writing paper, thus enabling the stable writing.

What is claimed is:

1. A writing device comprising:

A.) a main body portion filled with an ink;

B.) an ink flow-out control mechanism mounted to said main body portion, said ink flow-out mechanism comprising:

a valve main body mounted to said main body portion;

a valve seat mounted within said valve main body;

a valve element supported within said valve main body so as to be movable between an open valve position with a first end thereof abutted against said valve main body and a closed valve position with a second end thereof abutted against said valve seat, said open valve position opening a path between said valve seat and said valve element thereby allowing said ink to flow-out from within said main body portion, said closed valve position closing said path between said valve seat and said valve element thereby preventing said ink from flowing-out from within said main body; and a coil spring for biasing said valve element in said closed valve position against said valve seat, wherein said coil spring provides a spring pressure that is approximately identical to a pressure obtained during writing; and C.) a writing tip mounted to said second end of said valve element substantially directly adjacent to said path between said valve seat and said valve element for directly applying said ink to said writing tip when said path between said valve seat and said valve element is in said open valve position, said writing tip being movable with said valve element with the movement being initiated by exerting said pressure obtained during writing to said writing tip.

2. The writing device according to claim 1, wherein said main body portion is formed having an inner pipe and an outer pipe which are concentrically arranged with a heat shielding space formed annularly therebetween, said inner pipe being filled with said ink.

3. The writing device according to claim 2, wherein said inner pipe and said outer pipe are formed such that a first end of said inner pipe and a first end of said outer pipe are integrally joined and a second end of said inner pipe and a second end of said outer pipe are closed, and an external communication hole is formed in said outer pipe so as to allow external air to communicate with said heat shielding space thereby preventing a transfer of heat from said outer pipe to said inner pipe, thereby preventing an increase in pressure within said inner pipe, and thereby preventing an excessive flow-out of said ink out from within said inner pipe through said flow-out mechanism.

4. The writing device according to claim 1, wherein said valve element provides a restriction portion for restricting the amount said path between said valve seat and said valve element is opened.

5. The writing device according to claim 4, wherein said restriction portion is provided by a base portion of an insertion portion provided at said first end of said valve element with a moveable distance L put between a valve element supporting portion of said valve main body, said base portion of said insertion portion of said valve element abutting against said valve element supporting portion of said valve main body when said valve element is in said open position.

6. The writing device according to claim 1 or 5, wherein said spring pressure of said coil spring is specified to be smaller than said pressure exerted during writing such that said valve element is movable from said closed valve position by a pressure obtained through softly pressing said writing tip on a surface of a writing paper as in writing characters.

7. A writing device comprising:

a main body portion having an inner pipe and an outer pipe which are concentrically arranged with a heat shielding space formed annularly therebetween, said inner pipe being filled with an ink;

an ink flow-out control mechanism mounted to said inner pipe for controlling the flow of said ink out from within said inner pipe; and external communication holes formed in said outer pipe so as to allow external air to communicate with said heat shielding space thereby preventing a transfer of heat from said outer pipe to said inner pipe, thereby preventing an increase in pressure within said inner pipe, and thereby preventing an excessive flow-out of said ink out from within said inner pipe through said flow-out mechanism.

8. The writing device according to claim 7, wherein said inner pipe and said outer pipe are formed such that a first end of said inner pipe and a first end of said outer pipe are integrally joined and a second end of said inner pipe and a second end of said outer pipe are open.

9. The writing device according to claim 8, wherein said inner pipe and said outer pipe are formed by injection molding in such that said first end of said inner pipe and said first end of said outer pipe are integrally joined and said second end of said inner pipe and said second end of said outer pipe are open.

10. The writing device according to claim 8, wherein said writing device further comprises a tail plug fitted to said open second ends of said inner pipe and said outer pipe so as to enclose said heat shielding space between said pipes.

11. The writing device according to claim 10, wherein said tail plug is also fitted to said open second end of said inner pipe so as to enclose said second end of said inner pipe.

* * * * *